United States Patent [19]

DeWoolfson

[11] 4,345,679

[45] Aug. 24, 1982

[54] CONTAINER COLLECTION APPARATUS WITH ELECTROMAGNETIC SENSOR AND METHOD

[76] Inventor: Bruce H. DeWoolfson, 2200 Columbia Pike, #1113, Arlington, Va. 22204

[21] Appl. No.: 148,371

[22] Filed: May 9, 1980

[51] Int. Cl.[3] ..... G07F 07/06

[52] U.S. Cl. ..... 194/4 C; 100/902; 194/1 E; 194/4 E

[58] Field of Search ..... 194/1 E, 4 B, 4 C, 4 D, 194/4 E, 4 F, 4 G, 4 R; 100/DIG. 2; 209/567, 570, 571; 324/228, 233, 234, 235, 23.6; 221/84

[56] References Cited

U.S. PATENT DOCUMENTS

| | | | |
|---|---|---|---|
| Re. 27,643 | 5/1973 | Myers | 194/4 C |
| 1,901,528 | 3/1933 | Olsen . | |
| 2,558,255 | 6/1951 | Johnson et al. . | |
| 2,691,379 | 10/1954 | Foushee | 133/5 R |
| 2,908,440 | 10/1959 | Gurewitz . | |
| 2,943,306 | 6/1960 | Gray et al. | 324/233 X |
| 2,954,111 | 9/1960 | Garrard . | |
| 3,015,376 | 1/1962 | Glembring . | |
| 3,039,583 | 6/1962 | Menefee . | |
| 3,066,600 | 12/1962 | Couty et al. . | |
| 3,191,609 | 6/1965 | Gauselmann et al. . | |
| 3,343,638 | 5/1961 | Putman . | |
| 3,489,354 | 2/1967 | Harper et al. . | |
| 3,776,128 | 12/1973 | Morris . | |
| 3,792,765 | 2/1974 | Arp | 194/4 C |
| 3,857,334 | 12/1974 | Arp . | |
| 3,907,087 | 9/1975 | Tanaka . | |
| 4,010,766 | 3/1977 | Bowles et al. . | |
| 4,091,725 | 5/1978 | Arp . | |
| 4,130,792 | 12/1978 | Sullivan | 324/236 X |
| 4,141,493 | 2/1979 | Arp | 194/4 R X |
| 4,248,334 | 2/1981 | Hanley et al. | 194/4 C |

FOREIGN PATENT DOCUMENTS

| | | | |
|---|---|---|---|
| 354258 | 7/1905 | France | 221/84 |
| 52-8683 | 1/1977 | Japan | 209/567 |
| 286301 | 2/1928 | United Kingdom | 209/567 |

*Primary Examiner*—Robert J. Spar
*Assistant Examiner*—Edward M. Wacyra
*Attorney, Agent, or Firm*—Finnegan, Henderson, Farabow, Garrett & Dunner

[57] ABSTRACT

Apparatus for collection of metallic containers and for dispensing tokens therefor, including an exterior housing having an access port therein, a rotating belt having a plurality of generally perpendicular shelves formed thereon, each shelf for receiving and supporting a container, a search coil for exposing the container to an electromagnetic field for identifying a specific predetermined metallic composition, a dispenser for selectively dispensing a token for a received container having the predetermined metallic composition, a crusher cooperating with the rotating belt for crushing the container, and a hopper for storing the crushed containers.

14 Claims, 6 Drawing Figures

CONTAINER COLLECTION APPARATUS WITH ELECTROMAGNETIC SENSOR AND METHOD

BACKGROUND OF THE INVENTION

This invention relates to apparatus for collecting and storing used metallic containers and, more particularly, machines for collecting, crushing and storing used aluminum beverage cans in recycling, and for dispensing tokens in exchange for containers collected. This application is related to U.S. Patent application Ser. No. 06/106,104 filed Dec. 21, 1979 entitled "Apparatus for Collection of Metallic Containers and Method Therefor" by Bruce H. DeWoolfson, the same inventor herein.

With the increasing emphasis in recent years on energy conservation, the recycling of metallic containers such as beverage cans has become an important factor in the conservation effort. More specifically, the recycling of aluminum cans has proven to be remarkably efficient in energy saving. Yet only a fraction of the total annular production of aluminum beverage cans is recovered after use, with the remainder being discarded. This tremendous waste, to date, has been largely due to the lack of an efficient and economically feasible unit recovery system. Several machines have been developed in the prior art for encouraging the recovery and recycling of metallic containers. For example, U.S. Pat. Nos. 3,857,334 and 3,907,087 disclose apparatus for crushing metallic containers and discharging refund coins or tokens in exchange therefor. U.S. Pat. No. Re. 27,643 describes a process and apparatus for collection of metal containers in which tokens are automatically dispensed for the containers collected. In general, the prior art machines induct any type of inserted container, and then utilize some type of sensing means for differentiating between those containers for which a token is to be dispensed and those containers for which no payment is to be made. For example, Arp, U.S. Pat. No. 3,857,334 includes control means for issuing a token only when cans of a given size, weight and design are crushed in the machine. Myers, U.S. Pat. No. Re. 27,643 discloses a mechanism which utilizes a plurality of bar magnets for separating cans formed of magnetic material from non-magnetic cans.

Several of the prior art apparatus are designed to take advantage of the force of gravity in feeding the metallic containers into the apparatus. This type of feeding mechanism has an inherent drawback in that the containers must be sufficiently close to their original shape to roll down an inclined surface. As a result, a large majority of containers which have been totally or partially crushed by the user, cannot be fed into such machines efficiently. In addition, the sensing or differentiating mechanisms of the prior art machines do not appear to be adaptable to operation on partially or fully crushed containers of different sizes.

Accordingly, it is a primary object of this invention to provide an improved container collection apparatus which is capable of readily accepting containers in their originally manufactured shape, or containers which have been deformed by consumers.

It is a further object of this invention to provide a container collection machine with a sensing mechanism which can readily detect the presence of aluminum containers of varying sizes, and can do so prior to accepting the inserted container into the interior of the machine.

Another object of the invention is to provide an improved container collection apparatus with a mechanism for detecting the presence of aluminum containers which have been deformed from their originally manufactured shape.

It is an additional object of this invention to provide an improved method of collecting and storing empty aluminum containers and issuing a token therefor.

Additional objects and advantages of the invention will be set forth in part in the description which follows and in part will be obvious from the description, or may be learned by practice of the invention. The objects and advantages of the invention may be realized and obtained by means of the instrumentalities and combinations particularly pointed out in the appended claims.

SUMMARY OF THE INVENTION

To achieve the foregoing objects and in accordance with the purpose of the invention as embodied and broadly described herein, the apparatus of this invention comprises preselection means for exposing a crushed or non-crushed container offered by a customer to an electromagnetic field for identifying whether the container is substantially aluminum, the preselection means including a container access area configured to accommodate both crushed and non-crushed containers for exposure to the field; means for accepting only a container identified by the preselection means as being substantially aluminum, independent of the configuration of the container, coin-dispensing means responsive to the preselection means for dispensing coins in return for containers having a substantially aluminum composition; means cooperating with the accepting means for crushing the containers; and means for storing crushed containers received from the crushing means.

Preferably, the preselection means includes an oscillator and a search coil, the container being disposed adjacent the search coil by the means for receiving, and the oscillator supplying an electric current to the coil. It is also preferred that the preselection means include a detector coupled to the coil and the oscillator for sensing the variation in the electrical signal received from the coil.

The accepting means preferably includes conveying means for receiving the containers and depositing the containers by gravity into the crushing means. The conveying means preferably includes a rotating belt having a plurality of generally perpendicular shelves formed thereon, each of the shelves for receiving and supporting a container.

Preferably also, the apparatus includes an exterior housing having an access port therein, one of the shelves being positioned adjacent the port for allowing manual insertion of a container into the housing onto the one shelf. The apparatus may also include a door covering the access port and means preventing operation of the apparatus when the door is open.

BRIEF DESCRIPTION OF THE DRAWINGS

The accompanying drawings, which are incorporated in and constitute a part of the specification, illustrate one embodiment of the invention, and, together with the description, serve to explain the principles of the invention.

Of the drawings.

DESCRIPTION OF THE PREFERRED EMBODIMENT

Figure 1:
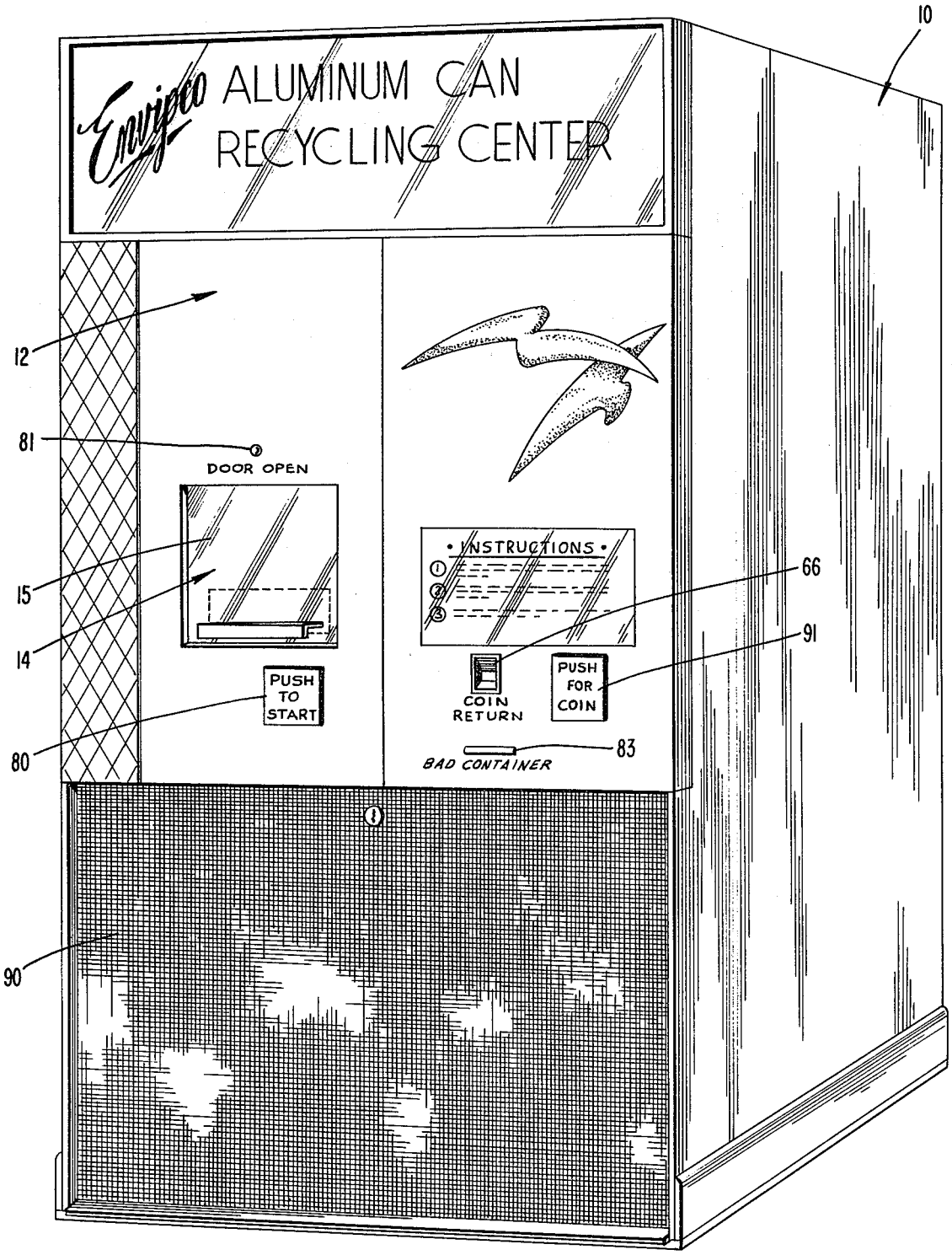
FIG. 1 is perspective view of the exterior of the apparatus.
Figure 2:
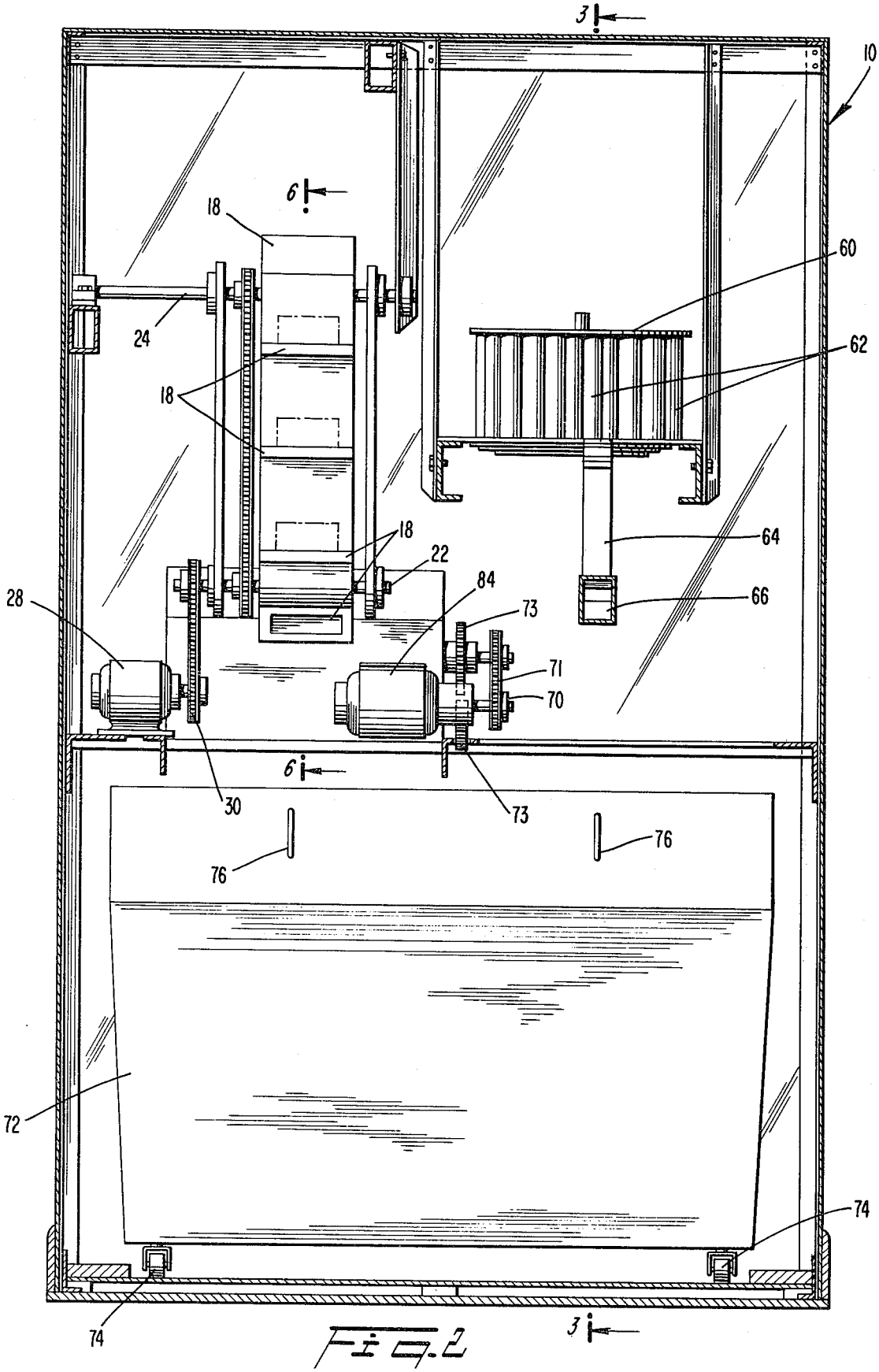
FIG. 2 is cutaway front view of the interior portion of the apparatus.
Figure 3:
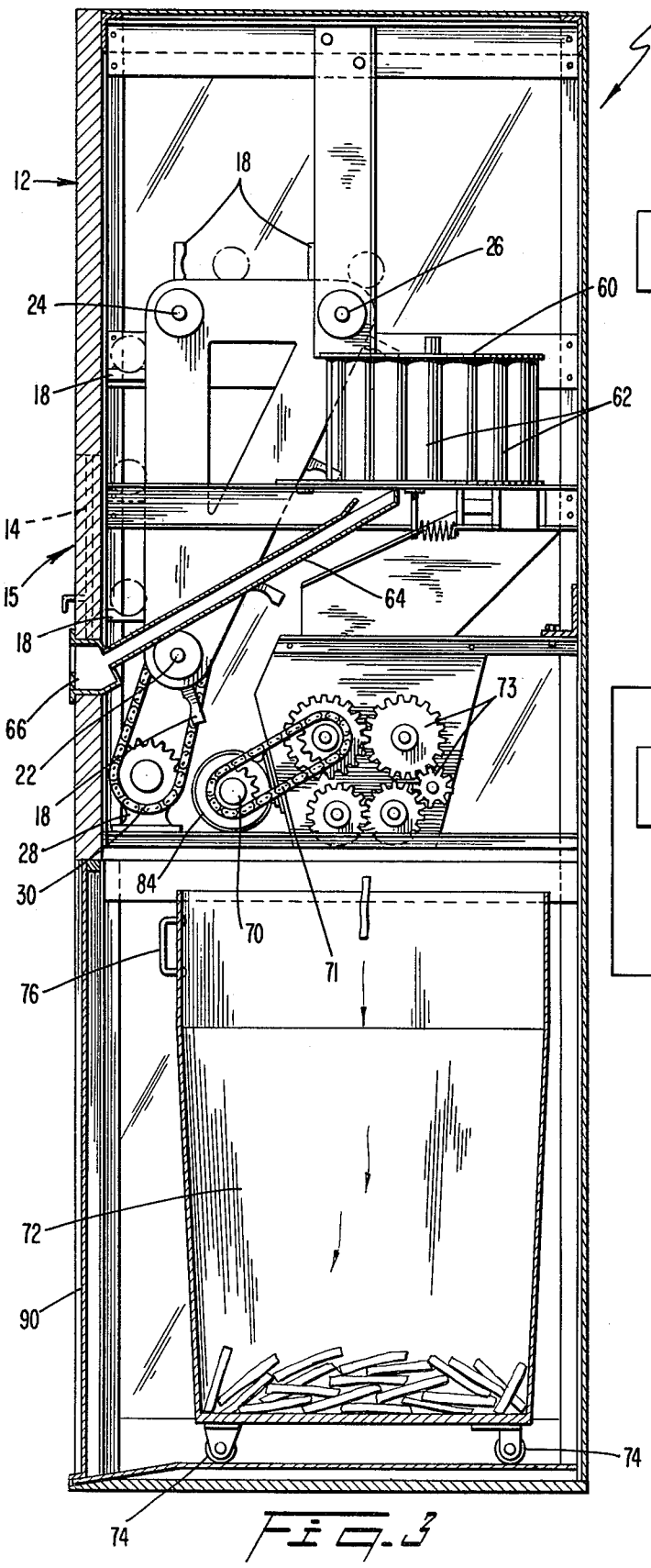
FIG. 3 is a right side cutaway view of the interior of the apparatus taken generally along the line 3—3 of FIG. 2.

Reference will now be made in detail to the present preferred embodiment, an example of which is illustrated in the accompanying drawings. Referring now to FIGS. 1, 2 and 3, it may be seen that the container collection apparatus provides a rapid and efficient means for collecting containers for recycling. The apparatus for collection of containers generally includes a rectangular cabinet housing 10 having a front wall 12 which is hinged to allow access to the interior of the housing 10 for maintenance of the operating components and to allow for removal of the containers collected in the apparatus.

In accordance with the invention, the apparatus includes preselection means for exposing a crushed or non-crushed container offered by a customer to an electromagnetic field for identifying whether the container is substantially aluminum without direct physical contact with the container, the preselection means including a container access area configured to accommodate both crushed and non-crushed containers for exposure to the field means includes an access port 14 in the front wall 12 of the housing 10. A door 15 covers the access port 14, and the door 15 may be provided with an electronic locking mechanism (not shown) which prevents operation of the apparatus when the door 15 is unlocked. The door 15 may also include means for automatically opening the door upon unlocking, such as a spring.

Figure 6:
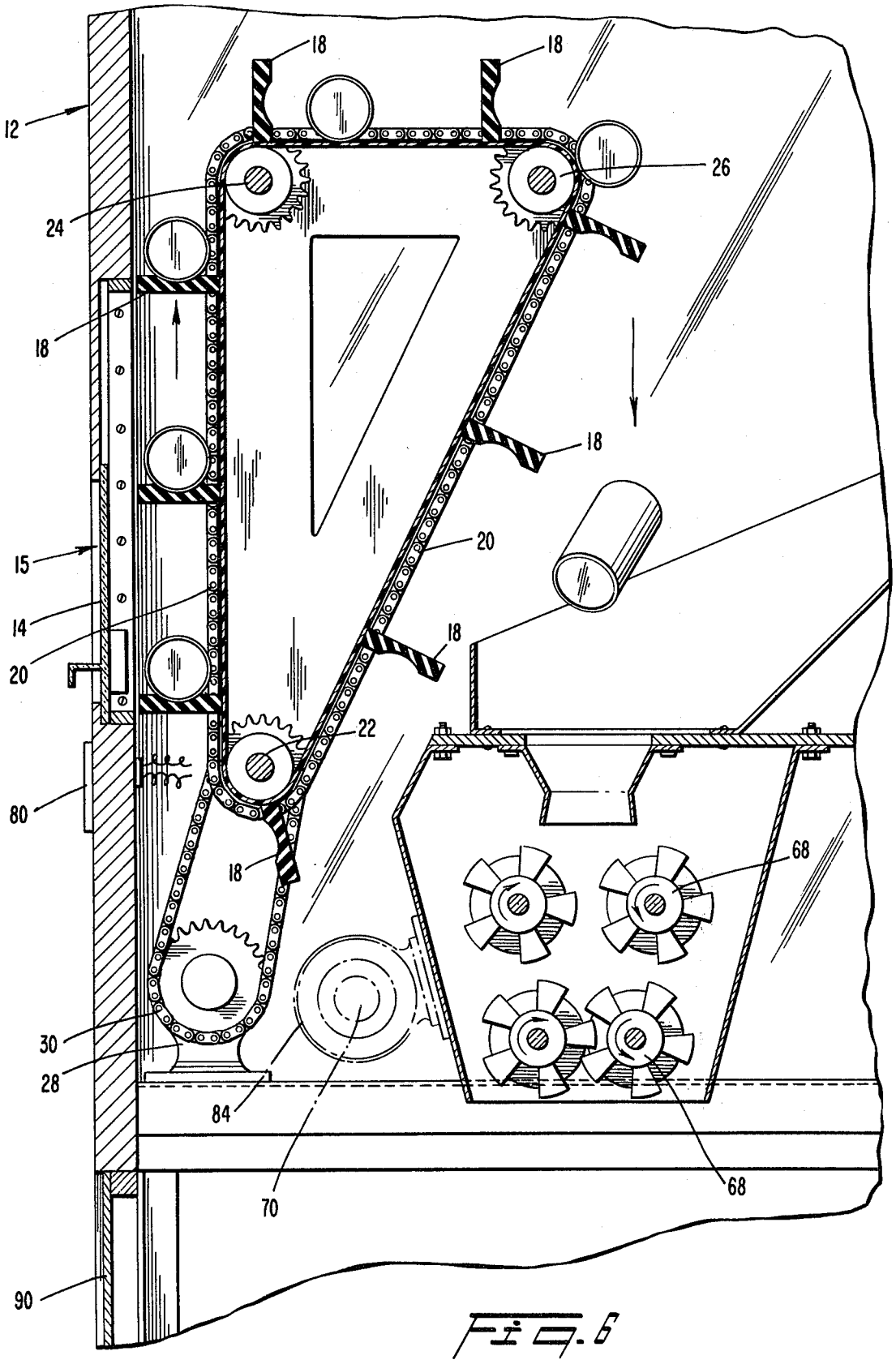
FIG. 6 is an enlarged cross-sectional view taken generally along the line 6—6 in FIG. 2.

In accordance with the invention, the apparatus also includes means for accepting only a container identified by the preselection means as being substantially aluminum, independent of the configuration of the container. Preferably, the accepting means also includes conveying means for lifting the containers and thereafter depositing the containers by gravity into a crushing means. The conveying means preferably includes a rotating belt having a plurality of generally perpendicular shelves formed thereon, each of the shelves for receiving and supporting a container. As here embodied, the conveying means includes a belt 16 formed of a flexible material such as rubber. The belt has a plurality of shelves 18 formed thereon at spaced intervals, each shelf for receiving and supporting a container. The shelves 18 are preferably formed of hard rubber or some other suitable non-conductive material. The belt 16 is mounted within the housing to allow individual alignment of the shelves with the access port 14. During operation, the belt 16 rotates at evenly spaced intervals, equal to the distance between two adjacent shelves 18. In the illustrated embodiment, the belt 16 is mounted for rotation in a generally right triangular configuration as shown in FIG. 6. The belt is controlled by a chain drive utilizing a chain 20 and three pinion gears, 22, 24 and 26. A suitable electric motor 28 is operatively connected through another chain 30 to provide power for the advancement of chain 20. As the belt rotates, containers are carried by the shelves upwardly from the access port 14, and then horizontally along the second leg of the triangular mounted belt. The containers then drop from the belt into a crushing means, described hereinafter.

Figure 4:
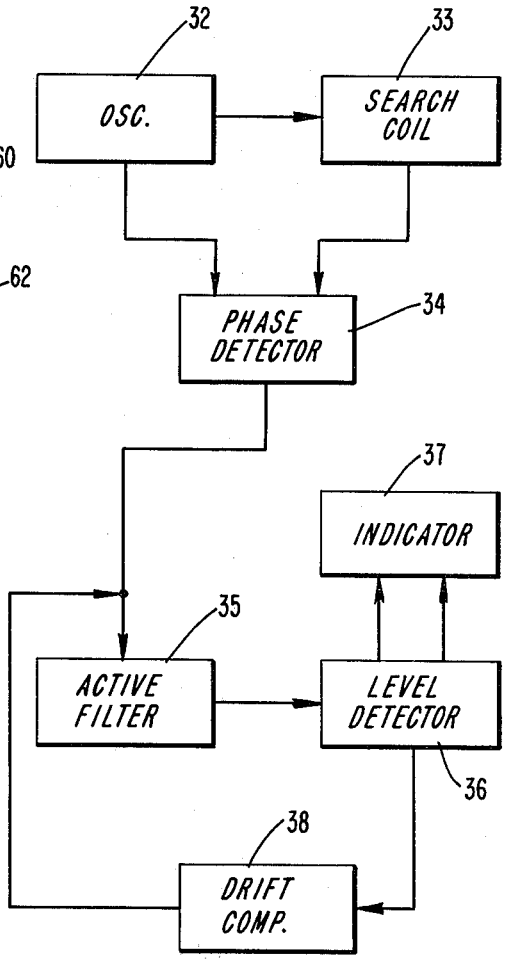
FIG. 4 is a block function diagram of the sensing components of the apparatus.

Preferably the preselection means includes an oscillator and a search coil, the container being disposed adjacent the search coil by the means for receiving, and the oscillator supplying an electric current to the coil. As here embodied and as best shown in FIG. 4, the preselection means includes an oscillator 32 and a search coil 33, the oscillator 32 supplying an electric current to the coil 33. The coil 33 is mounted in the apparatus so that a container inserted into the access port 14 onto one of the shelves 18 will be initially disposed adjacent the search coil 33. As shown in FIGS. 1 and 6, the coil may be mounted on the rear of the door 15 covering the access port 14. However, other configurations and designs may be used.

The preselection means also includes a phase detector 34 coupled to the coil 33 and the oscillator 32 for sensing the variation in the electrical signal received from the coil 33. The electrical signal from the coil 33 will reflect a variation resulting from the interaction of the electromagnetic field and the container. The phase detector compares the signal from the oscillator 32 with the signal from the search coil 33, and generates an output based upon the variation in those signals. The output from the phase detector 34 is fed to an active filter 35 which removes extraneous noise from the electrical signal. The signal is then fed to a level detector 36 which detects the signal level received from the phase detector 34 through the active filter 35. An indicator 37 which is shown as a two level indicator, senses the level of signal in the level detector to determine whether it satisfies one of two conditions. If the container has the desired composition, the indicator will show one condition, and if the container is unacceptable, the other condition.

If desired, a drift compensator 38 may also be utilized to stabilize the circuit.

In the illustrated embodiment, the preselection mechanism is actuated by a current from the apparatus power supply (not shown). When an acceptable container is determined to be present, the current through the sensing circuit is cut off and the conveying and dispensing means are actuated.

If a container having a composition other than desired is inserted into the access port 14, and the sensing means are actuated, the identification circuitry will indicate that an undesired container is present, and the apparatus will not operate further to accept the container. Thus, only containers of a predetermined metallic composition will be received and crushed by the apparatus.

When the operation of the preselection means identifies the composition of the container as a desired one, the rotating belt 16 is rotated upward to bring the next available shelf into alignment with the access port 14.

Figure 5:
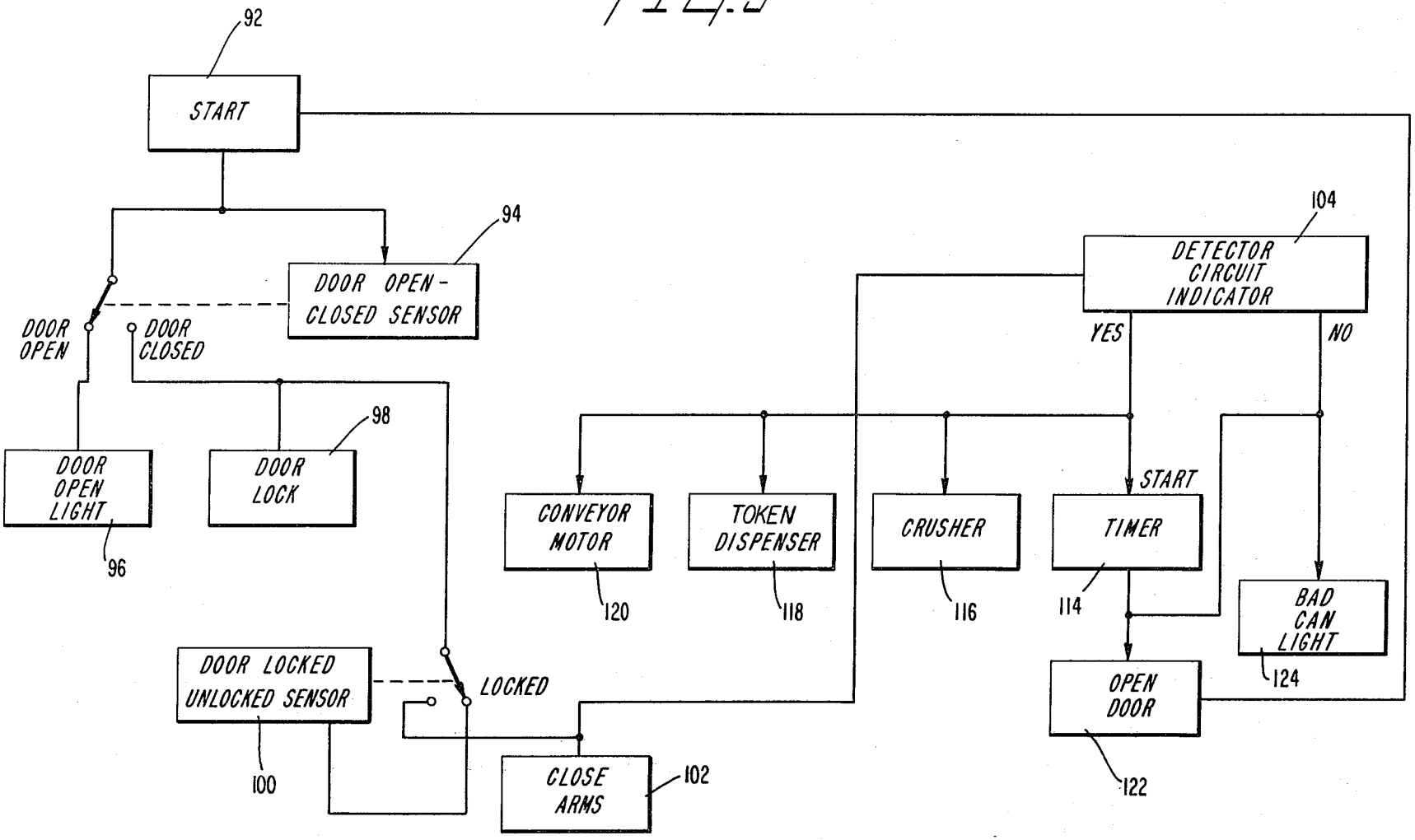
FIG. 5 is a block functional diagram of the electrical components of the apparatus.

In accordance with the invention, the apparatus also includes coin-dispensing means responsive to the preselection means for dispensing coins in return for containers having a substantially aluminum composition. As here embodied, the dispensing means includes an interchangeable coin magazine 60 having a plurality of coin tubes 62 mounted vertically about the circumference of the magazine 60. As shown in FIG. 3, a coin chute 64 is provided to channel individual coins or tokens to be dispensed to a slot 66 on the front facing surface 12 of the housing 10. The dispensing means is electrically connected to the sensing means by appropriate circuitry as generally shown in FIG. 5, and is responsive thereto. Thus, a coin is dispensed only in response to receipt of a container of a predetermined metallic composition such as aluminum. If desired, a counter (not shown) may be employed to calculate the refund due for multiple containers received. A coin magazine having coin sleeves for different sized coins may be used with the counter to allow a single refund of correct change in return for receipt of several containers. With this embodiment, a push-button 91 may be used to signal when the refund is to be paid.

The use of the interchangeable circular coin magazine allows for rapid servicing of the machine since a full coin magazine may be quickly interchanged with the empty or partially filled magazine in the machine.

The coin dispensing means of the apparatus may also include suitable sensors (not shown) to indicate when the coin magazine is emptied and to actuate a signal light on the front of the apparatus.

In accordance with the invention, the apparatus also includes means cooperating with the accepting means for crushing the containers. As here embodied, the crushing means includes a series of rotating crushing wheels 68 arranged within the housing so as to receive the individual containers by gravity. A suitable driving mechanism 70 is operatively connected to the crushing wheels 68 for rotation thereof. The driving mechanism 70 includes a chain 71 and a series of gears 73 for controlling the crushing wheels 68. In operation, a container present on a shelf 18 is lifted by the belt 16 and deposited by gravity into the path of the crushing wheels 68. As shown in FIG. 6, the crushing wheels 68 are mounted in progressively closer relation, the lowermost wheels being intermeshed to provide staged compression of the container.

The apparatus also includes storage means for receiving crushed containers from the crushing means and for storing the crushed containers. As here embodied, the storage means comprises a hopper 72 positioned in the lower portion of the housing 10. As illustrated, the hopper is mounted on casters 74 and includes suitable handles 76 for facilitating removal of the hopper from the apparatus. The hopper is accessible by opening the hinged front wall 12 of the housing 10. Alternatively, a separate disposal door 90 may be provided in the housing 10 for removing the hopper 72.

An additional signal light may be provided on the front of the housing 10 indicating when a received container does not have the predetermined metallic composition desired. This signal light is connected to the sensing means by appropriate circuitry (not shown) and is responsive to the sensing means.

The sequence of operation of the apparatus of the present invention is initiated when an operator lifts the door 15 on the front of the housing 10, and inserts a container onto the shelf 18 opposite the access port 14. The operator then closes the door 15 and pushes manual pushbutton 80 on the front wall 12 of the housing 10. Preferably, appropriate electrical circuitry and sensors (FIG. 5) are provided to verify at this point in the operation of the apparatus that the door 15 is closed. This same circuitry may be utilized to activate an optional signal light 81 on the front wall 12 of the apparatus to indicate that the door 15 is not fully closed. Activation of the manual push-button also energizes a solenoid (not shown) which operates a mechanism for bolting the door 15 securely.

When the door 15 is securely bolted, an appropriate electrical switch (FIG. 5) is closed causing the sensing mechanism to be energized. The sensing mechanism then activates causing the container to be exposed to an electromagnetic field from the search coil 33 to determine if the composition of the container is a desired material. If the container is determined to have an undesirable composition the current to the sensing circuit cuts off, a signal light 83 is activated on the front wall 12 of the apparatus to indicate that the container is not of the desired composition, and the door 15 is automatically opened. The above sequence of operation will also take place if the manual push-button 80 is activated with no container present on the shelf. Optionally, appropriate sensing devices may be used in place of the manual push-button 80 to indicate the presence of a container on the shelf 18. In this configuration, the electromagnetic sensing means is energized automatically upon closing of the safety door 15.

If the indicator 37 shows that the composition of the container is of the desired type, the motor 28 is started to rotate the belt 16 a sufficient distance to bring the next available shelf 18 into alignment with the access port 14. Simultaneously, a motor 84 is energized causing the driving mechanism 70 to rotate the crushing wheels 68. Thus, a container which has been lifted by the belt 18 and carried to a position adjacent pinion 26 will fall by gravity into the path of the crushing wheels 68.

The coin dispensing mechanism is also activated in response to an indication from the preselection means of the presence of a desired container. As the belt 16 rotates to lift the inserted container out of the path of the access port 14, the coin dispenser ejects a coin through the coin chute 64 to the slot 66. The coin dispenser may also be provided with circuitry to activate a signal light (not shown) on the front of the apparatus for indicating that the apparatus is full, or that no further coins are available for dispensing.

After ejection of the coin and operation of the crushing wheels for a predetermined period of time sufficient to compress the container, the crushed container falls by gravity into the hopper 72, and the cycle of the apparatus is complete. The automatic lock on the safety door 15 is then electrically released and the machine is ready to receive another container.

The apparatus is designed to operate on standard power supply and is preferably contained within an upright housing which is visually comparable in size to a soft drink dispensing machine.

The block functional diagram in FIG. 5 depicts one embodiment of a circuit for use in the apparatus of this invention. The sequence is initiated by the start block 92 which corresponds to activation of the push-button 80. A door open-closed sensor 94 then checks the status of the door 15. If the door is open, a door-open light 96 is activated. If the door is closed, the door lock 98 is energized and a door locked sensor 100 initiates the current flow to the detector circuit (block 102). If the detector indicator 104 indicates that a container has the predetermined composition desired, the timer 114, crusher 116, token dispenser 118 and conveyer 120 are all activated.

When the timer 114 deactivates, the door 15 is automatically unlocked (122) and the start sequence is reset.

If an undesired composition is detected by the detector indicator 104, a bad can light is then activated as shown at block 124.

It will be apparent to those skilled in the art that various other electrical circuitry could be used without departing from the scope and spirit of the invention.

The apparatus may be provided with separate access ports to accommodate different sized containers or containers of different composition. In addition, the structure of the apparatus may be modified to allow reception of containers of different compositions, with a different token response for each container. In addition, modifications to crush and store the different containers in segregated storage locations could be made by those skilled in the art.

In addition to the apparatus described in detail above, the invention also comprises a method of collecting and storing empty aluminum containers and issuing payment for containers collected. The method of the present invention comprises the steps of exposing a crushed or non-crushed container offered by a customer for identifying whether the container is substantially aluminum, accepting only a container identified by exposure to the field as being substantially aluminum, independent of the configuration of the container dispensing payment for containers accepted, crushing the accepted containers, and depositing the crushed containers in a receptacle for storage. The method may be accomplished through the use of the apparatus described above, or through any other suitable apparatus which utilizes the disclosed steps.

It will be apparent to those skilled in the art that various other modifications and variations could be made in the structure of the invention without departing from the scope and spirit of the invention.

What I claim is:

1. Apparatus for collecting and storing empty aluminum containers and issuing payment for containers collected, comprising:

preselection means for exposing a crushed or non-crushed container offered by a customer to an electromagnetic field for identifying whether said container is substantially aluminum without establishing direct electrical contact with said container, said preselection means including a container access area configured to accomodate both crushed and non-crushed containers for exposure to said field;

means for accepting only a container identified by said preselection means as being substantially aluminum, independent of the configuration of said container;

coin-dispensing means responsive to said preselection means for dispensing coins in return for containers having a substantially aluminum composition;

means cooperating with said accepting means for crushing said containers; and means for storing crushed containers received from said crushing means.

2. The apparatus of claim 1 wherein said preselection means includes an oscillator and a search coil, said container being disposed adjacent said search coil by a customer, and said oscillator supplying an electric current to said coil.

3. The apparatus of claim 2 wherein said preselection means includes a detector coupled to said coil and said oscillator for sensing the variation in electrical signal received from said search coil.

4. The apparatus of claim 3 wherein said preselection means includes means for indicating when said container is substantially aluminum.

5. The apparatus of claim 4 wherein said accepting means includes conveying means for removing said container from said container access area and thereafter depositing said container by gravity into said crushing means.

6. The apparatus of claim 5 wherein said conveying means includes a rotating belt having a plurality of generally horizontal shelves formed thereon, each of said shelves for receiving and supporting a container.

7. The apparatus of claim 6 also including an exterior housing having an access port therein, one of said shelves being positioned adjacent said port for allowing manual insertion of a container into said apparatus onto said one shelf.

8. The apparatus of claim 7 wherein said housing includes a safety door for covering said access port, and means preventing operation of said apparatus when said safety door is open.

9. The apparatus of claim 8 also including means responsive to the insertion of a container into said access port for actuating said preselection means upon closing of said safety door.

10. The apparatus of claim 8 also including manual pushbutton means for actuating said preselection means.

11. The apparatus of claim 10 wherein said preselection means includes regret means for activating a signal when a received container does not have a substantially aluminum composition.

12. The apparatus of claim 11 wherein said means for storing comprises a hopper and said housing includes a disposal door for permitting removal of said hopper.

13. The apparatus of claim 12 wherein said dispensing means includes an interchangeable circular coin magazine, said magazine having a plurality of coin tubes mounted vertically about the circumference of said magazine.

14. A method of collecting and storing empty aluminum containers and issuing payment for containers collected, comprising the steps of:

exposing a crushed or non-crushed container offered by a customer to an electromagnetic field for identifying whether said container is substantially aluminum;

accepting only a container identified by exposure to said field as being substantially aluminum, independent of the configuration of said container;

dispensing payment for containers accepted;

crushing the accepted containers, and depositing the crushed containers in a receptacle for storage.

* * * * *